US010715901B2

(12) United States Patent
Gordeyev

(10) Patent No.: US 10,715,901 B2
(45) Date of Patent: Jul. 14, 2020

(54) IMPROVING CANALPHONE PERFORMANCE USING LINEAR IMPEDANCE TUNING

(71) Applicant: Vitaliy Y. Gordeyev, Oregon City, OR (US)

(72) Inventor: Vitaliy Y. Gordeyev, Oregon City, OR (US)

(73) Assignee: 1964 Ears, LLC, Vancouver, WA (US)

( * ) Notice: Subject to any disclaimer, the term of this patent is extended or adjusted under 35 U.S.C. 154(b) by 0 days.

(21) Appl. No.: 15/915,838

(22) Filed: Mar. 8, 2018

(65) Prior Publication Data

US 2019/0281375 A1 Sep. 12, 2019

(51) Int. Cl.

| | |
|---|---|
| ***H04R 1/10*** | (2006.01) |
| ***H04R 1/24*** | (2006.01) |
| ***H04S 1/00*** | (2006.01) |
| ***H04R 9/06*** | (2006.01) |
| ***H04R 3/14*** | (2006.01) |
| ***H04R 11/02*** | (2006.01) |

(52) U.S. Cl.

CPC ..... *H04R 1/1016* (2013.01); *H04R 1/24* (2013.01); *H04R 3/14* (2013.01); *H04R 9/063* (2013.01); *H04R 11/02* (2013.01); *H04S 1/005* (2013.01)

(58) Field of Classification Search

CPC ..... H04R 1/24; H04R 1/1016; H04R 3/14; H04R 9/063; H04R 11/02; H04S 1/005

See application file for complete search history.

(56) References Cited

U.S. PATENT DOCUMENTS 7,194,103 B2 * 3/2007 Harvey ..... H04R 1/1016 381/380

9,137,609 B2 * 9/2015 Bruss ..... H04R 1/1008

* cited by examiner

*Primary Examiner* — Brian Ensey

(74) *Attorney, Agent, or Firm* — Mersenne Law

(57) ABSTRACT

Audio reproduction devices, including without limitation headphones, universal in-ear monitors and custom in-ear monitors, are improved by electrical design that targets a flat electrical impedance across a predetermined frequency range such as the typical audible range of 20 Hz-20 kHz. Headphones and earphones having a flat or linear electrical impedance characteristic will have more consistent audio performance when driven by different sources.

19 Claims, 9 Drawing Sheets

IMPROVING CANALPHONE PERFORMANCE USING LINEAR IMPEDANCE TUNING

CONTINUITY AND CLAIM OF PRIORITY

This is an original U.S. patent application.

FIELD

The invention relates to electro-acoustic audio transducers in the nature of headphones and earphones. More specifically, the invention relates to electronics and circuit design techniques to improve acoustic rendition characteristics of such devices.

BACKGROUND

Traditional personal listening devices such as headphones and earphones utilize one or more drivers as audio reproduction sources. The drivers convert a signal (which is typically electrical) into mechanical vibrations that cause air pressure waves. These waves travel into the listener's ear canal, where they affect the ear drum (tympanic membrane) and activate the mechanical, bioelectric and biochemical systems connected thereto, resulting in the user's perception of an audible sound corresponding to the signal.

Earphones are the final stage of a signal processing pipeline which allows a sound produced at one time and place, to be heard by somebody at a different time or place. The pipeline may include microphones, analog-to-digital ("A/D") converters, recorders, mixers, digital-to-analog ("D/A") converters and/or amplifiers. It is often a goal of each processing stage to avoid unintentional modification of the sound—this is described as a "flat" frequency response, indicating that the various frequency components of the signal are mostly unchanged from input to output, so that the output faithfully reproduces the original sound (or, often, the sound mix prepared by a recording or mixing engineer from recordings of the original musicians' instruments).

One situation that affects earphones and headphones disproportionately often (compared to other "last stage" audio transducers such as full-size loudspeakers) is the use of the earphones with different signal sources. For example, a single pair of headphones may be used at various times with a cellular telephone, a portable music player, an instrument amplifier, or the output of a mixing board at a live concert. The different sources commonly have different output impedances, which give rise to an undesirable audio effect: the headphones produce different output sound, even if the same signal is provided to the next-to-last stage (typically an amplifier of some sort).

This is problematic because headphones and earphones are carefully designed to produce a particular sound from a given input—even if they are not tuned to produce a flat response, they are tuned to produce a desired response, but when driven by a different source, they may fail to perform as expected. Circuit and system design techniques that improve the consistency of headphone audio reproduction when driven by different sources may be of significant value in this field.

SUMMARY

Embodiments of the invention are personal listening devices (headphones, earphones, canalphones, in-ear monitors, etc.) having specific novel and measurable, but non-audible characteristics that allow the devices to perform consistently when driven by signal sources of varying impedance.

DETAILED DESCRIPTION

Figure 2:
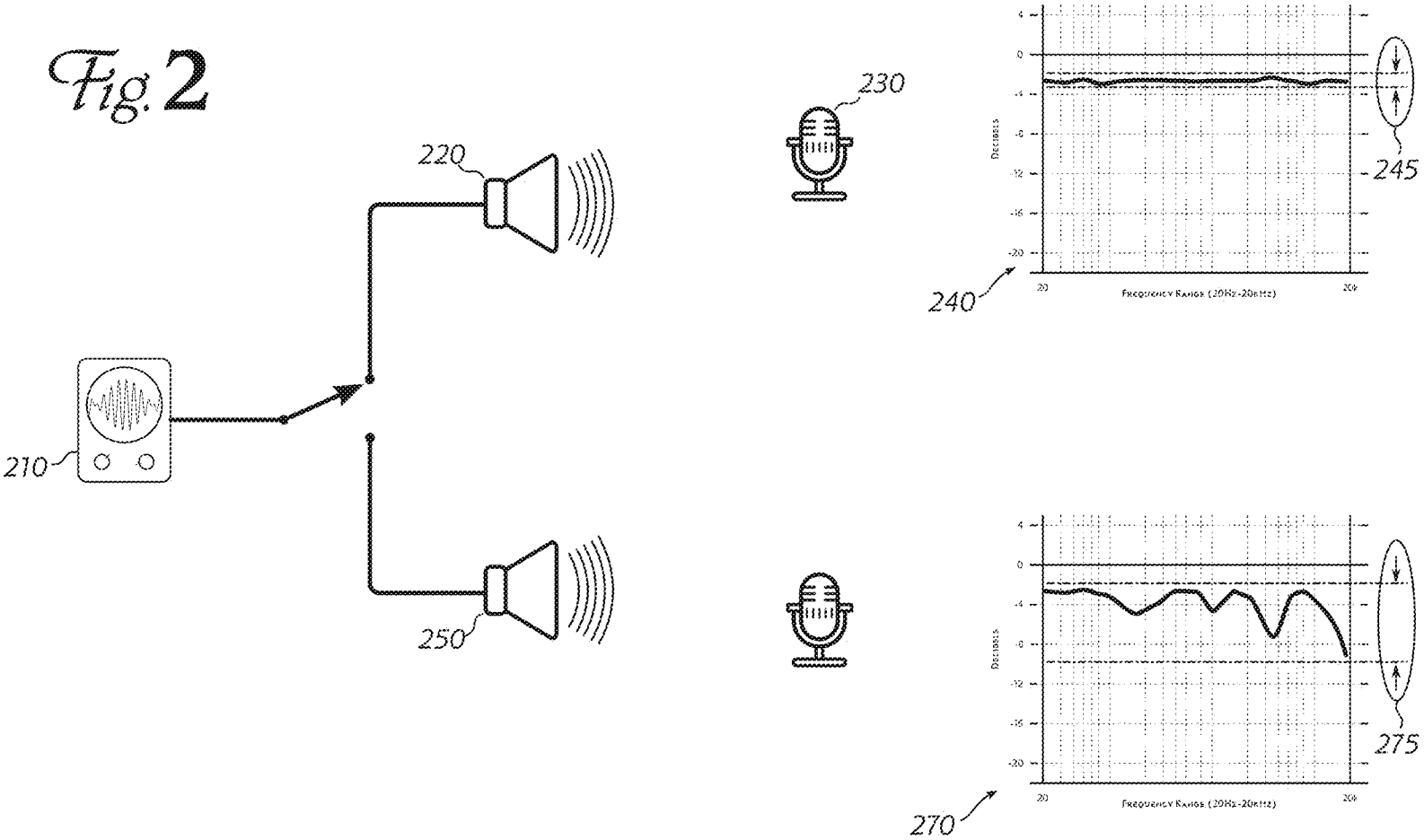
FIG. 2 illustrates how two different audio transducers may be compared.

Audio reproduction devices convert a signal (often electrical) into atmospheric pressure variations with frequencies generally in the range of 20 Hz through 20 kHz. Some individuals can perceive sounds at lower and/or higher frequencies, but 20-20,000 Hz is often considered representative of the bulk of the audible range. The quality or accuracy of audio reproduction of a speaker or headphone is often evaluated as "flatness" of a frequency-response plot (refer to FIG. 2): sample signals of identical power but varying frequency (signal generator 210) are applied to a speaker 220, and its response is measured (e.g. by microphone 230). A speaker whose response is roughly equal across the frequency range 240 (e.g., within ±3 dB at any tested frequency, 245) may be considered better, or more accurate, than another, different speaker 250 whose response 270 is uneven (i.e. has a variation exceeding 3 dB at some frequencies, 275).

Figure 1A:
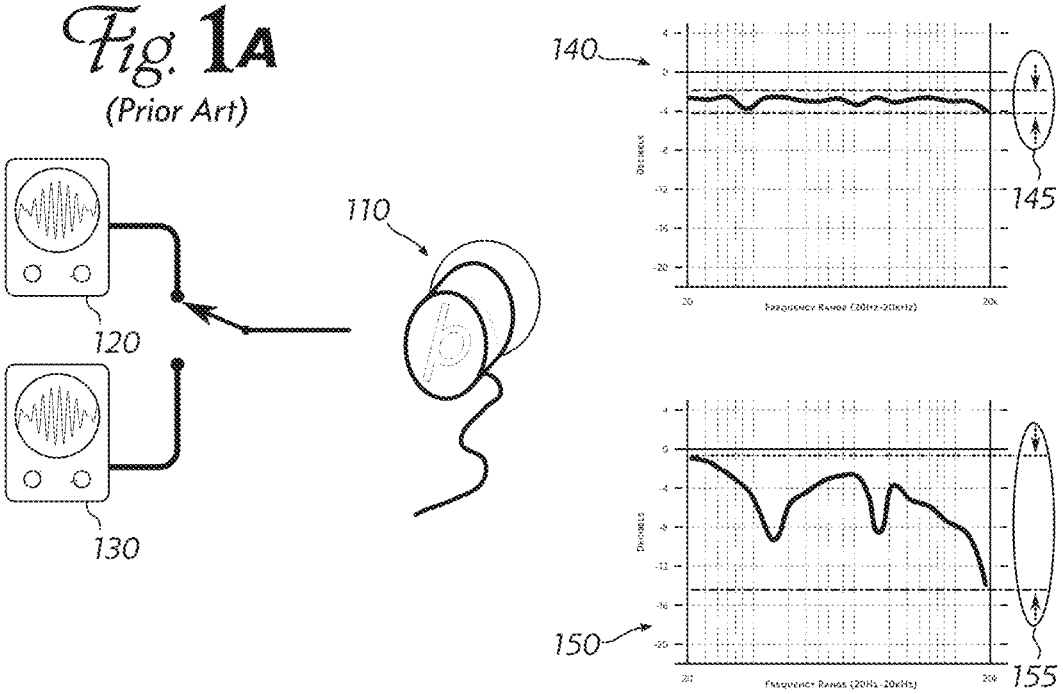
Fig. 1A (Prior Art)
FIGS. 1A and 1B show how a prior-art headphone differs from a headphone implementing an embodiment of the invention.

Embodiments of the invention address a similar, but inverted, situation. As shown in FIG. 1A, a prior-art earphone 110 is tested with different signal sources 120 and 130. These sources are configured to produce the same signal, but they have different output impedances. Because the prior-art earphone lacks the distinguishing characteristics of an embodiment, its output varies significantly depending on the input selected. With source 120, the earphone's response 140 may be acceptably flat (145), but when driven by source 130, the earphone's response 150 is significantly colored (155), so it is not performing as its designers intended.

Figure 1B:
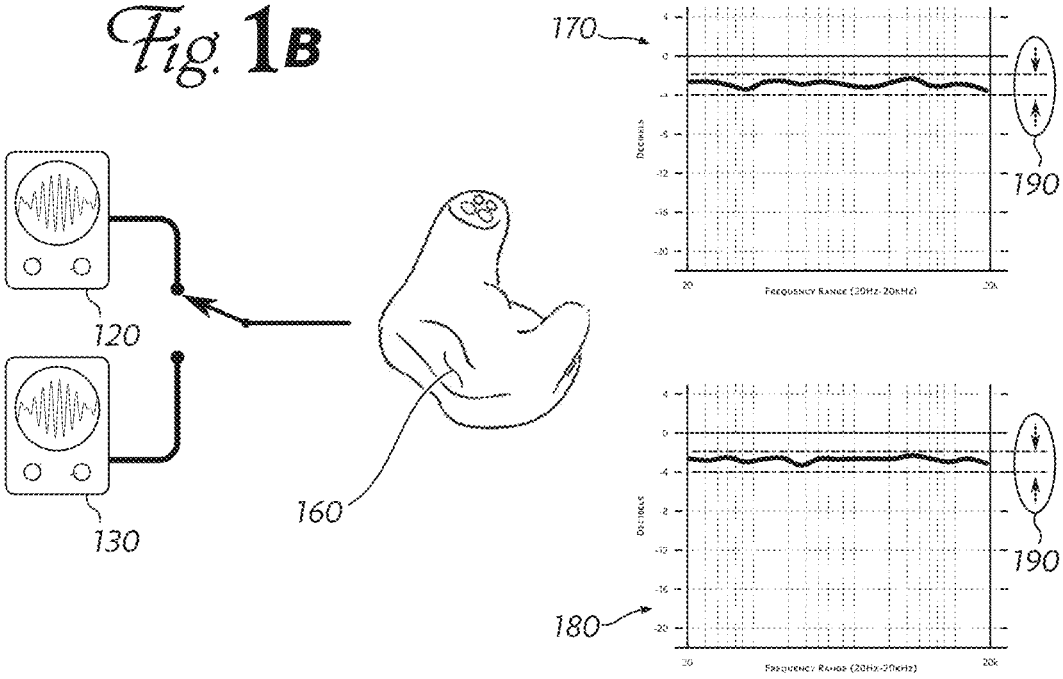

FIG. 1B shows an earphone 160 which implements an embodiment of the invention. When driven by either source 120 or 130, the earphone's response (170, 180) does not change significantly. (It is impractical to construct an earphone whose response does not change at all, but using an embodiment allows a designer to control the output response to within an acceptable margin of variation 190 over a range of different source impedances.) It should be appreciated that an earphone's designed response may not be flat (i.e., it may be colored so that certain frequencies or bands are emphasized or diminished). An embodiment does not assure that the frequency response remains flat when driven by different-impedance sources, but that it remains consistent when driven by those different sources. In other words, if the response plots are superimposed, the outputs at any particular frequency will be within the acceptable margin of variation—for example, they will be within ±3 dB or ±6 dB. Of course, a headphone whose designed response is substantially flat, will exhibit a substantially flat response when driven by other sources as well. Different embodiments may be distinguished by the frequency range over which the electrical impedance is roughly linear, and the response correspondingly consistent. A basic embodiment may be consistent over the standard "audible" range of 20 Hz-20 kHz. A lower-cost embodiment may have relaxed specifications, with consistency evaluated over a narrower range such as 80 Hz-16 kHz. A "precision" embodiment may be designed to show linear impedance and consistent reproduction over a wider frequency range, such as 20 Hz-23 kHz.

Figure 3:
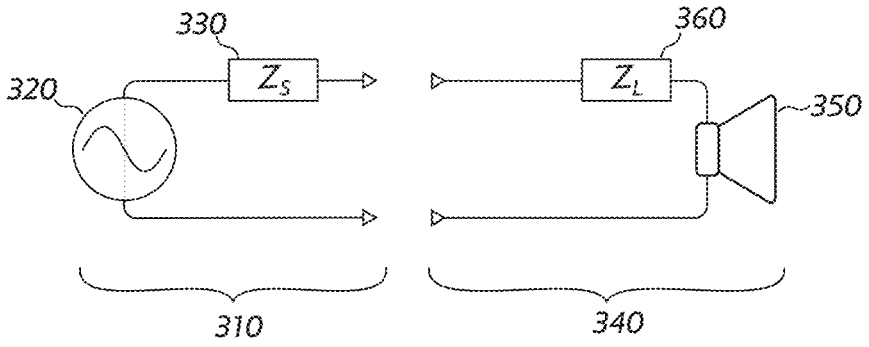
FIG. 3 shows a simplified equivalent circuit schematic where an embodiment of the invention may be employed.

The system characteristic that causes a headphone to perform differently when driven by different sources is the source impedance. FIG. 3 depicts a simplified model circuit that will be referenced in the following description of embodiments of the invention. The audio source 310 is represented as a varying voltage source 320 in series with a source impedance 330. The value of this impedance $Z_S$ may vary between different sources. Some sources have a very low impedance—very close to zero ohms—while others are higher—e.g. 4Ω or 5Ω.

The source drives an audio reproduction device or transducer 340, such as a headphone or earphone. The transducer is represented as an ideal speaker 350 in series with a load impedance 360. This idealized representation often hides substantial complexity—the actual headphones may comprise one or more electronic crossover networks to direct certain ranges of input frequencies to one or more of a multitude of real audio transducers (which may be, for example, balanced armatures, piezoelectric drivers or traditional moving-coil speakers). However, for purposes of understanding an embodiment, the crossover(s) and transducers can be treated as the Thévenin equivalent shown here. Embodiments are especially useful for improving the performance of headphones comprising at least one crossover network and a plurality of audio transducers.

It is commonly understood that power transfer from source 310 to load 340 is greatest when $Z_S=Z_L$. But in view of the modest power levels at which headphones operate, efficiency of power transfer is not an especially important consideration. Instead, the audible effect of differing source impedances is that headphones sound different when driven by different sources. It is appreciated that low source impedance often provides better results, but if the load (headphone) impedance is nonlinear, then the audible response will be different—possibly in an undesired or unfavorable way—when the headphones are driven by different sources. Thus, what is critical, and addressed by embodiments of the invention, is linearity of load impedance by frequency. Note that load impedance is not an audible characteristic, but rather an electrical one.

Figure 4:
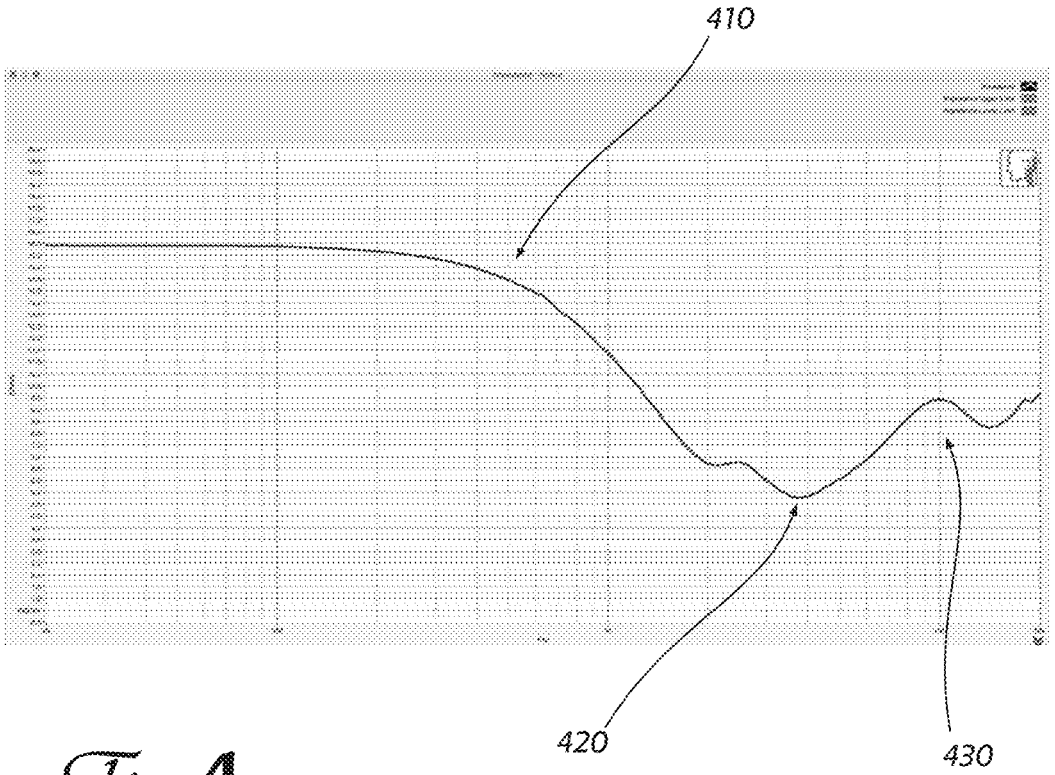
FIG. 4 is a graph of a measurable but non-audible characteristic of a headset prior to treatment according to an embodiment.

FIG. 4 shows a sample impedance plot of a headphone without an embodiment of the invention. The impedance is fairly constant at about 16Ω from 20 Hz to about 300 Hz, but then begins decreasing with increasing frequency (410), eventually reaching a minimum of about 5.5Ω at 3.8 kHz (420) before rising erratically to about 9.5Ω at 20 kHz (430). This nonlinear impedance may be tolerable if the headphones are always used with the same signal source (any undesired sound color can be tuned out by adjusting the signal source, for example) but it becomes intolerable if the headphones are used with different sources having different source impedances—the headphones will sound different, or each source will have to be specially tuned (and re-tuned again to match a different set of headphones that may be connected.)

Figure 5:
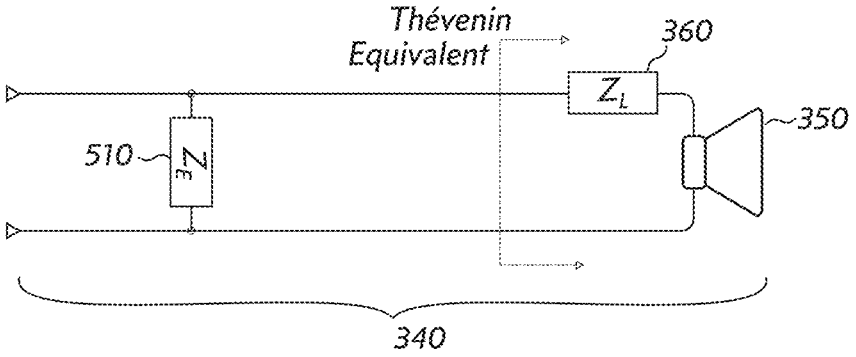
FIG. 5 shows an equivalent circuit schematic illustrating a modification according to an embodiment.

An embodiment of the invention comprises a reactive impedance $Z_E$ positioned as shown in FIG. 5 at 510. In this "shunt" configuration, $Z_E$ has little or no effect on the audio performance of the headphone; its purpose is to alter the electrical impedance of the headphone. When the headphone is used with a low-impedance amplifier, $Z_E$ has little effect, but when the headphone is used with a higher-impedance amplifier, $Z_E$ ensures that the higher impedance does not translate to colored sound reproduction. In other words, a headphone with shunt load $Z_E$ according to an embodiment will produce its intended design sound with sources of low or high impedance. $Z_E$ does not affect sound directly, but it does affect the electrical impedance seen by the source. $Z_E$ is a reactive load—its impedance is explicitly frequency dependent because it comprises reactive components such as capacitors and/or inductors. The inventor is aware of some prior-art attempts to improve the impedance linearity of headphones and earphones by placing a non-reactive resistor in the shunt or dummy-load position shown. This approach does accomplish some of the goals of an embodiment, but at too high a cost—to achieve moderate linearity, the dummy load resistance must be quite low, and it really only "swamps" the frequency-dependent $Z_L$ of the headphone, making the headphone consume much more power without a corresponding increase in audio volume. A low-valued shunt resistor consumes audio power across the frequency spectrum, requiring the source to deliver higher currents to achieve the same audible volume (i.e., a shunt resistor reduces the sensitivity of the headset). Drawing increased current from the source also increases the stress on the source and may cause degradation or damage. Therefore, use of a non-reactive (resistive) dummy load is a poor option.

Figure 6:
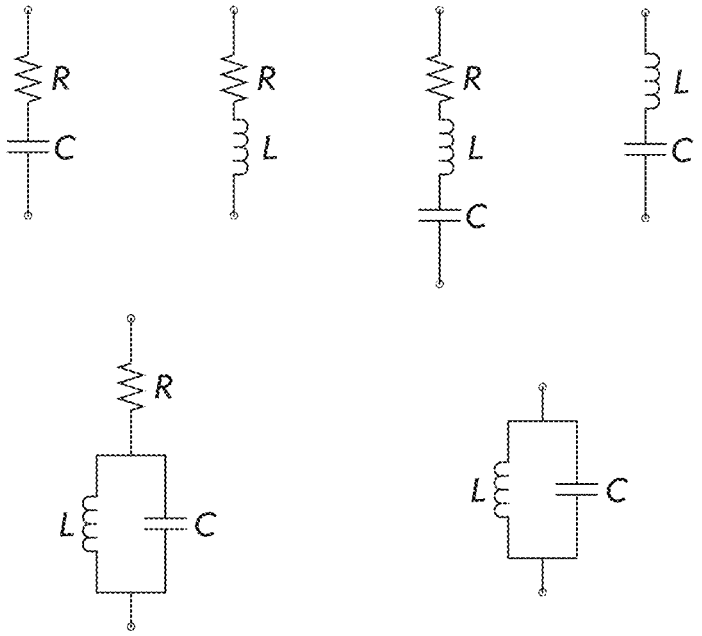
FIG. 6 shows several alternative circuits that may be added to a headset according to an embodiment.

In an embodiment, the shunt load $Z_E$ may be constructed as shown in the examples of FIG. 6. The various configurations (and alternate arrangements that will be apparent to circuit designers of ordinary skill) have impedance characteristics of a low-pass, high-pass or band-pass filter whose cutoff frequencies depend on the component values in a well-known way. When placed across the input conductors of a headphone (i.e. in the position of $Z_L$ 510 in FIG. 5) they will reduce the headphone's impedance over the range of frequencies that the filter passes. Thus, the impedance of the headphone, as seen from the source, can be adjusted to be closer to flat across the audible spectrum, and the headphone's sound will be less affected when used with sources of different impedance.

Figure 7:
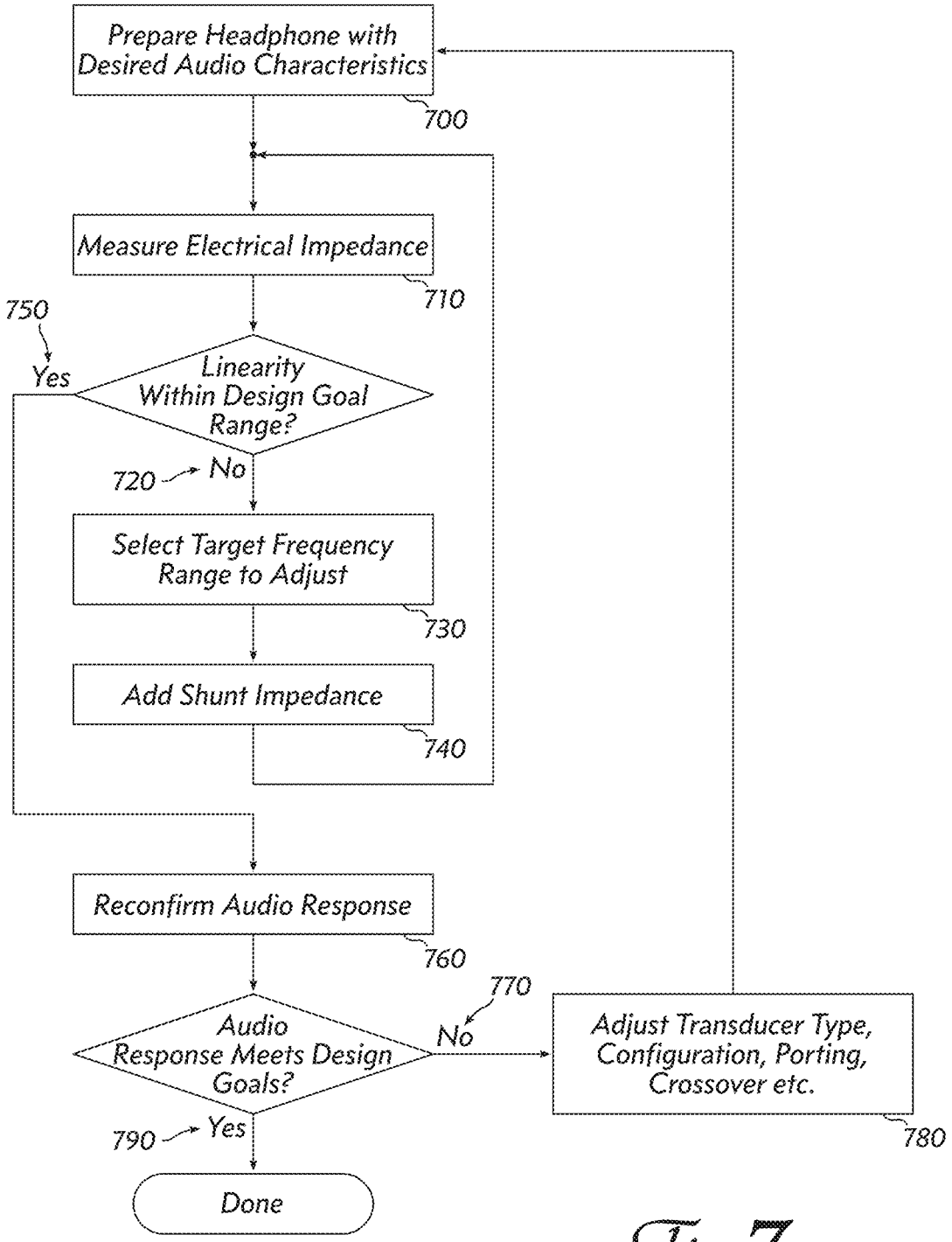
FIG. 7 outlines a method for correcting the measurable, non-audible characteristic of a headset according to an embodiment of the invention.

FIG. 7 outlines a method by which a designer can apply the principles of an embodiment of the invention to linearize the input impedance of a headphone such as that represented by the plot of FIG. 4. First, a headphone having a desired audio response is developed (700). This process may include testing and selecting from among balanced armature transducers, piezoelectric drivers, and moving-coil speakers; designing sound chambers, passageways and pressure vents; and specifying suitable electronic crossovers and connection topologies so that all of the components can be housed in the small space available. Once the headphone's audio performance is satisfactory, its electrical impedance is measured (710) at frequencies across the audible spectrum. If the electrical impedance is not within an acceptable design range of the nominal impedance over a portion of the spectrum (720), then one of out-of-compliance frequency ranges is selected (730) and a shunt load (for example, a circuit like one of those shown in FIG. 6) is added across the signal lines, as shown in FIG. 5 (740). The impedance by frequency is measured again (710) and the process is repeated until the impedance is acceptably constant across the audible spectrum (750).

Now, the audio performance is evaluated again (760). If it does not meet the design goals (770), then the transducer type, location, connection, or other characteristics are adjusted to correct the audio response (780) and the impedance-correction process is repeated. Once both the audio performance and impedance linearity satisfy design goals (790), the headphone is complete.

Figure 8:
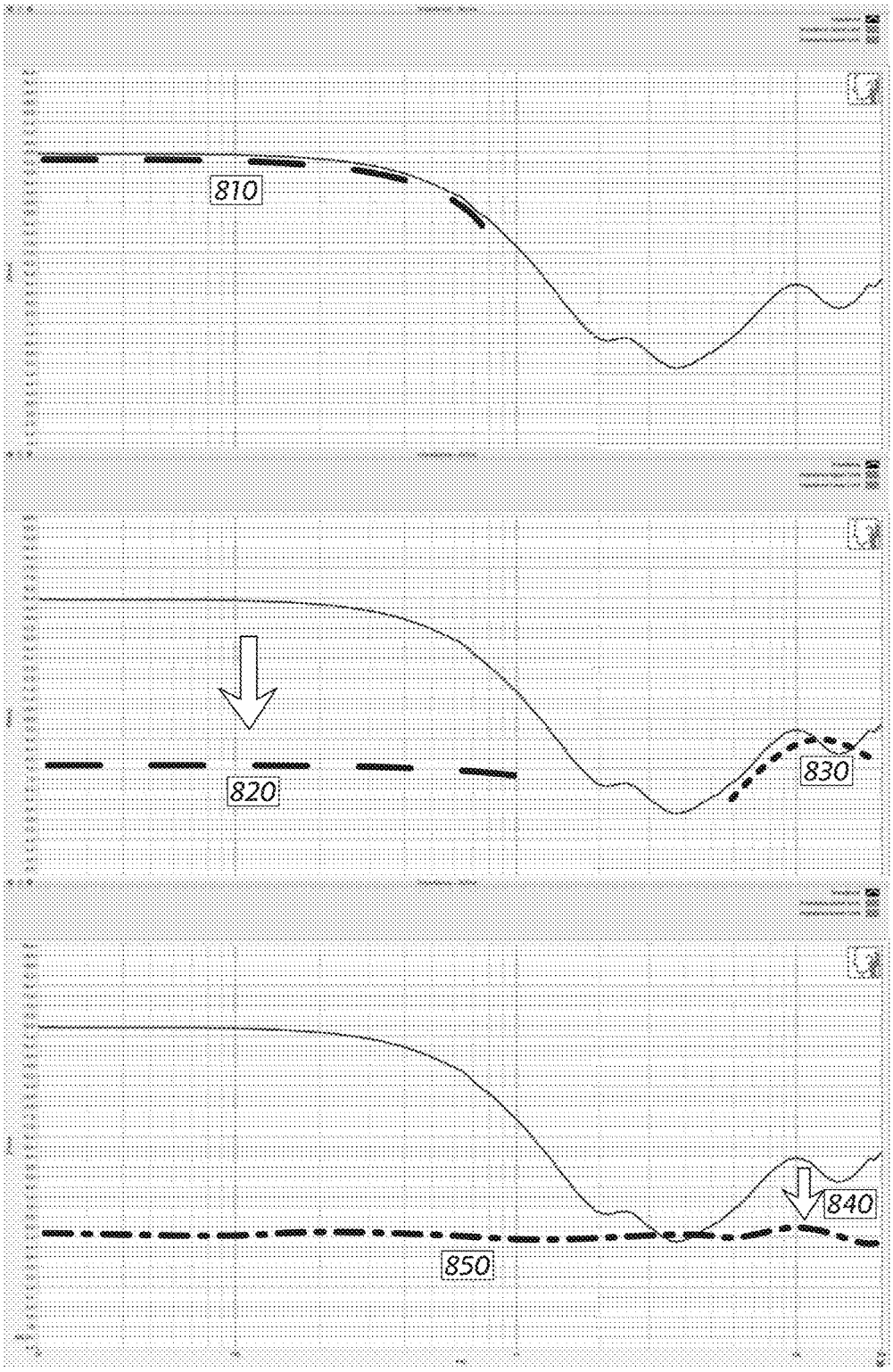
FIG. 8 shows how corrections according to the embodiment improve the measurable, non-audible characteristic of a headset.

FIG. 8 shows how the impedance-uncorrected headphone of FIG. 4 might be improved so that its audio performance is more consistent when driven by sources of varying impedance. First, note that the impedance from 20 Hz to about 1 kHz (810) is higher than the lowest impedance at about 3.5 kHz. Thus, according to an embodiment, a low-pass dummy load $Z_E$ having a cutoff frequency around 500 Hz may be placed. This will reduce the low-frequency impedance as shown at 820, without affecting other parts of the impedance curve.

Next, the erratically increasing impedance at 830 can be addressed with a high-pass or band-pass filter. When such a load is added, it reduces the impedance "bump" between about 8 kHz and about 13 kHz (840), giving an overall flatter impedance curve 850.

Figure 9:
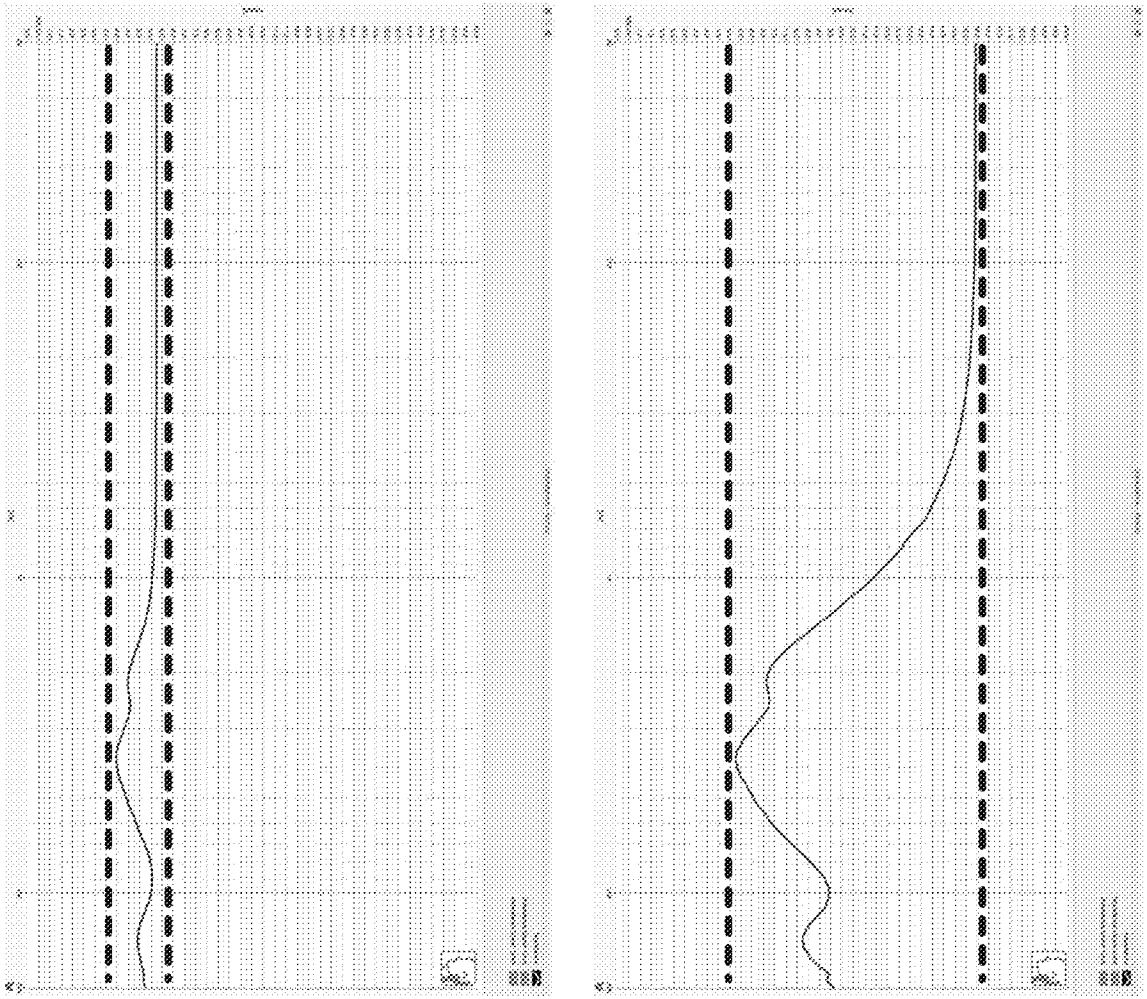
FIG. 9 shows before-and-after graphs of the measurable, non-audible characteristic that is improved by an embodiment of the invention.

FIG. 9 shows the actual uncorrected and corrected impedance curves of a headset (i.e., before and after application of the method FIG. 7). The uncorrected impedance ranges from about 5.25Ω at 3.5 kHz to almost 16Ω over most of the very low frequencies (20-100 Hz). After correction, the low impedance is about 4Ω at 3.5 kHz, but the high impedance is only 5.75Ω. An absolute variation of only 1.75Ω, or a proportional variation of ±20% of the average value, is adequately constant to deliver the benefits of an embodiment. Further tuning of the load impedance may provide even lower variation, but the added complexity and sensitivity to component tolerance may make such tuning economically unfavorable.

A distinguishing characteristic of an embodiment is roughly constant electrical impedance of a headphone over a range of frequency inputs (e.g., the range from 20 Hz to 20 kHz, from 20 Hz to 23 kHz, from 80 Hz to 16 kHz, or another similar range). For present purposes, "roughly constant" may be taken to mean "not varying by more than a predetermined amount over the frequency range." For example, if the nominal impedance of the headphone is 4Ω, then the actual impedance at any frequency in the range should be between 2.25Ω and 5.75Ω (i.e., ±1.75Ω); or between 3Ω and 5Ω (i.e., ±25% of nominal). Alternatively, one may measure the actual impedance over the frequency range, and ensure that the minimum and maximum impedance values are within a fixed range of the average actual impedance, or within a percentage range of the average actual impedance. An embodiment provides greater consistency in the face of source-impedance changes as the headphone or earphone impedance variation by frequency is reduced. Thus, a headphone with variation of only ±20% of nominal or actual impedance, or only ±15% of nominal or actual impedance, is likely produce more consistent audio output when driven by different sources.

Figure 10:
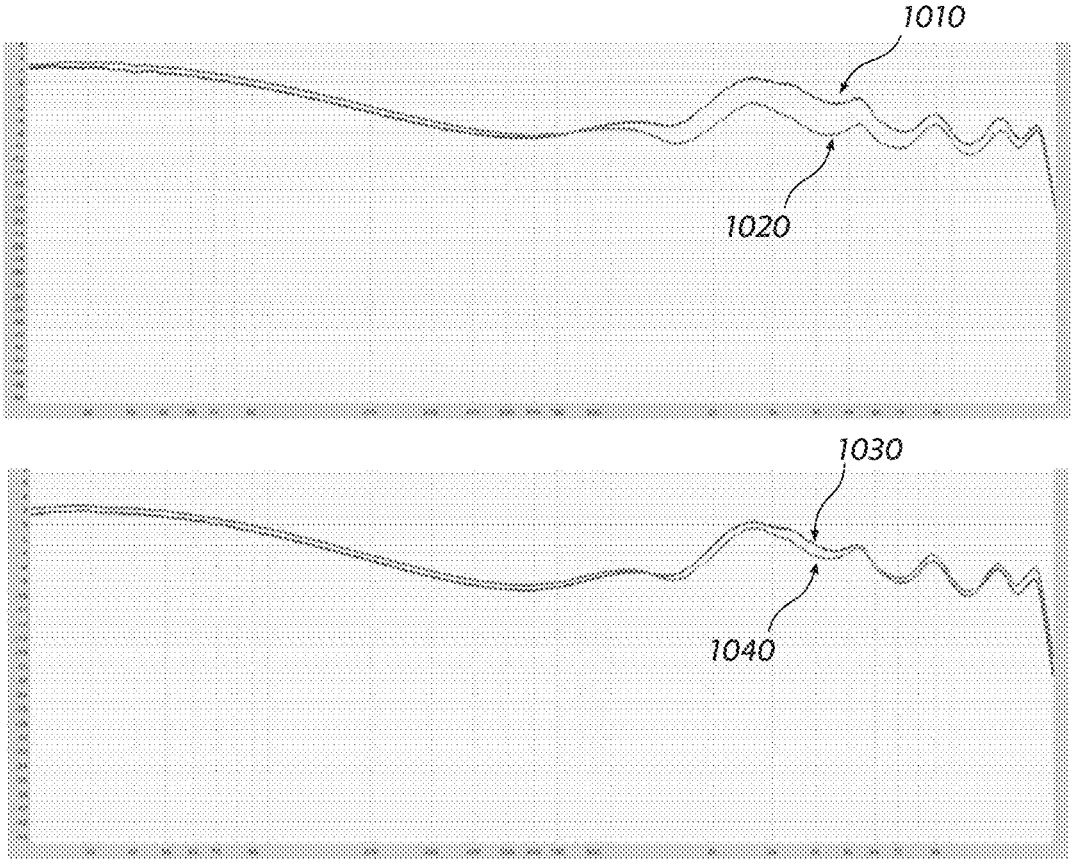
FIG. 10 shows how the linearizing the impedance of a headphone improves the consistency of its audio output when driven by different sources.

FIG. 10 shows comparison audio performance graphs for a headphone before and after impedance correction according to an embodiment. The upper graph corresponds to the uncorrected impedance plot of FIG. 9 (also upper graph). The two traces correspond to the response of one headphone being driven by two different sources (i.e., similar to the arrangement shown in FIG. 1A). Note that although the audio responses are similarly-shaped, they diverge by more than 3 dB (e.g. at 1010, 1020). Also note that the portion of the frequency range over which the audio responses deviate (above about 900 Hz), is similar to the frequency range in FIG. 9, upper graph, over which the impedance varies.

The lower graph of FIG. 10 compares the audio performance of an impedance-corrected headphone according to an embodiment, when driven by the same two sources that produced the upper graph from a prior-art, uncorrected headphone. The audio responses are much more consistent; the greatest variation is less than about 1.5 dB. This shows that the audio performance of the impedance-corrected headphone is much less sensitive to differences between audio sources—it will reproduce sounds as its designers intended, with less dependence on the characteristics of the audio source.

Embodiments of the invention may be used to improve the performance and consistency of over-the-ear headphones, on-ear headphones and universal-fit in-ear monitors, as well as custom-molded earphones and canalphones. The latter devices may comprise a housing that is molded or shaped to fit a particular user's outer ear and ear canal, while the housing of the others may be sized and shaped to fit all users, or a range of users (e.g., small, medium and large sizes). All of these audio reproduction devices may comprise crossover networks and multiple audio transducers (per side), with the crossovers and transducers installed in the housing.

Figure 11:
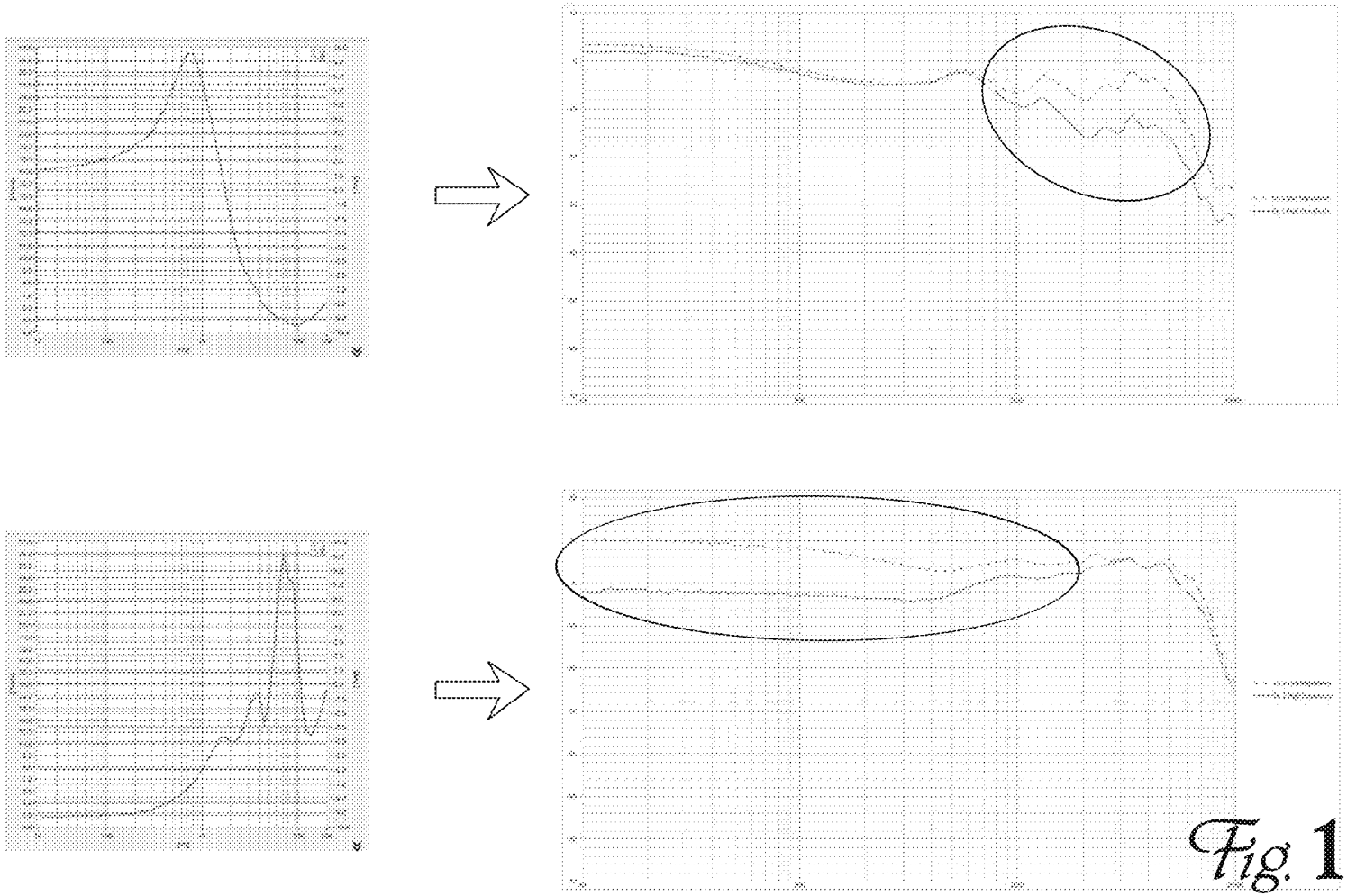
Fig. 11 (Prior Art)
FIG. 11 shows some impedance and audio response graphs of prior-art headphones, illustrating the relationship between nonlinear impedance characteristics and undesirable sound coloration.

FIG. 11 shows impedance-by-frequency and audio-output-by-frequency graphs for two sample prior-art earphones. Since the impedance is non-linear and has not been corrected as disclosed herein, the audio frequency response of the headphones when driven by sources of different impedances are also significantly different—the output sound is colored in an undesirable manner just by using the headphones with a different source. Embodiments of the invention make headphones perform more consistently between sources, and are therefore of value in this area of technology.

The applications of the present invention have been described largely by reference to specific examples and in terms of particular arrangements of circuit elements and components. However, those of skill in the art will recognize that headphones having linear impedance characteristics can also be constructed using variations of the elements and topologies described herein. Such variations are understood to be captured according to the following claims.

I claim:

1. A personal audio reproduction device comprising:

a plurality of audio transducers, each audio transducer operative to convert a time-varying electrical signal into audible sound waves similar to the time-varying electrical signal; and a crossover network to separate an input electrical signal into a plurality of electrical sub-signals, said electrical sub-signals coupled to the plurality of audio transducers, wherein an equivalent electrical impedance of the audio reproduction device measured from a perspective of a signal source driving the audio reproduction device does not vary by more than ±1.75Ω at any point across a predetermined frequency range.

2. A personal audio reproduction device comprising:

a plurality of audio transducers, each audio transducer operative to convert a time-varying electrical signal into audible sound waves similar to the time-varying electrical signal; and a crossover network to separate an input electrical signal into a plurality of electrical sub-signals, said electrical sub-signals coupled to the plurality of audio transducers, wherein an equivalent electrical impedance of the audio reproduction device measured from a perspective of a signal source driving the audio reproduction device does not vary by more than ±25% of a nominal impedance of the personal audio reproduction device at any point across a predetermined frequency range.

3. A personal audio reproduction device comprising:

a plurality of audio transducers, each audio transducer operative to convert a time-varying electrical signal into audible sound waves similar to the time-varying electrical signal; and a crossover network to separate an input electrical signal into a plurality of electrical sub-signals, said electrical sub-signals coupled to the plurality of audio transducers, wherein an equivalent electrical impedance of the audio reproduction device measured from a perspective of a signal source driving the audio reproduction device does not vary by more than ±25% of an average actual impedance of the personal audio reproduction device at any point across a predetermined frequency range.

4. The personal audio reproduction device of claim 1 wherein the predetermined frequency range is from 20 Hz to 20 kHz.

5. The personal audio reproduction device of claim 1 wherein the predetermined frequency range is from 80 Hz to 16 kHz.

6. The personal audio reproduction device of claim 1 wherein the plurality of audio transducers and the crossover network are contained within a housing.

7. The personal audio reproduction device of claim 6 wherein the housing is custom-shaped to complement an outer ear and ear canal of a listener.

8. The personal audio reproduction device of claim 6 wherein the housing is a universal shape suitable for any one of a plurality of listeners.

9. The personal audio reproduction device of claim 6 wherein the housing is an over-the-ear headphone.

10. The personal audio reproduction device of claim 6 wherein the housing is an on-the-ear headphone.

11. A personal audio reproduction device comprising:

a plurality of audio transducers, each audio transducer operative to convert a time-varying electrical signal into audible sound waves similar to the time-varying electrical signal; and a crossover network to separate an input electrical signal into a plurality of electrical sub-signals, said electrical sub-signals coupled to the plurality of audio transducers, wherein an equivalent electrical impedance of the audio reproduction device measured from a perspective of a signal source driving the audio reproduction device does not vary by more than a predetermined amount at any point across a frequency range from 20 Hz to 23 kHz.

12. The personal audio reproduction device of claim 11, wherein the plurality of audio transducers and the crossover network are contained within a housing.

13. The personal audio reproduction device of claim 12, wherein the housing is custom-shaped to complement an outer ear and ear canal of a listener.

14. The personal audio reproduction device of claim 2, wherein the predetermined frequency range is from 20 Hz to 20 kHz.

15. The personal audio reproduction device of claim 2, wherein the plurality of audio transducers and the crossover network are contained within a housing.

16. The personal audio reproduction device of claim 15, wherein the housing is custom-shaped to complement an outer ear and ear canal of a listener.

17. The personal audio reproduction device of claim 3, wherein the predetermined frequency range is from 20 Hz to 20 kHz.

18. The personal audio reproduction device of claim 3, wherein the plurality of audio transducers and the crossover network are contained within a housing.

19. The personal audio reproduction device of claim 18, wherein the housing is custom-shaped to complement an outer ear and ear canal of a listener.

* * * * *